United States Patent [19]

Waters

[11] 3,947,034

[45] Mar. 30, 1976

[54] MARBLE GAME BOARD WITH SURFACE POCKETS

[75] Inventor: John L. Waters, Los Angeles, Calif.

[73] Assignee: The Raymond Lee Organization, Inc., New York, N.Y. ; a part interest

[22] Filed: Mar. 12, 1975

[21] Appl. No.: 557,505

[52] U.S. Cl. ..... 273/123 R; 273/95 R; 235/90

[51] Int. Cl.[2] ..... A63F 7/00

[58] Field of Search ..... 273/123 R, 105, 120 R, 273/138 R, 121 R, 123 A, 113, 109, 110, 111, 112, 113, 114, 115, 116, 117, 130 R, 130 A, 87 R, 87 A, 87 B, 87 C, 87 D, 87 E, 131 R, 131 B, 131 BA, 131 K, 131 KN, 148 R, 134 R, 134 G, 135 R, 136 H, 176 E, 178 R, 124 R, 124 A, 125 R, 125 A, 126 R, 126 A, 101, 95 R; DIG. 34/5 TT; 46/43

[56] References Cited

UNITED STATES PATENTS

| | | | |
|---|---|---|---|
| 197,336 | 11/1877 | Cooper | 273/148 R |
| 575,097 | 1/1897 | Beam | 273/123 R |

*Primary Examiner*—Anton O. Oechsle
*Assistant Examiner*—T. Brown
*Attorney, Agent, or Firm*—Daniel Jay Tick

[57] ABSTRACT

A cross-shaped gameboard has four arms extending radially from a central area and equiangularly spaced by 90° from each other. The arms are of equal dimensions. A pocket is provided in each of the arms in the area of the end thereof farthest from the central area. Each of the pockets is adapted to accommodate a marble. A plurality of channels are formed in each of the arms and extend radially from the pocket in each of the arms. Rails extend along the edges of the arms to retain marbles on the arms. A plurality of marbles are provided. At the center of the gameboard, the marble are arranged in a square pattern such that when an additional marble is held at a height above the gameboard and dropped to a central area among the marbles, the marbles will be struck by the dropped marble and displaced thereby. The object of the game is to attempt to displace the marbles from the center of the gameboard and cause each to roll along an arm and fall into a pocket at the end of an arm. Each struck marble has a different color and each pocket has a color corresponding to a marble.

2 Claims, 3 Drawing Figures

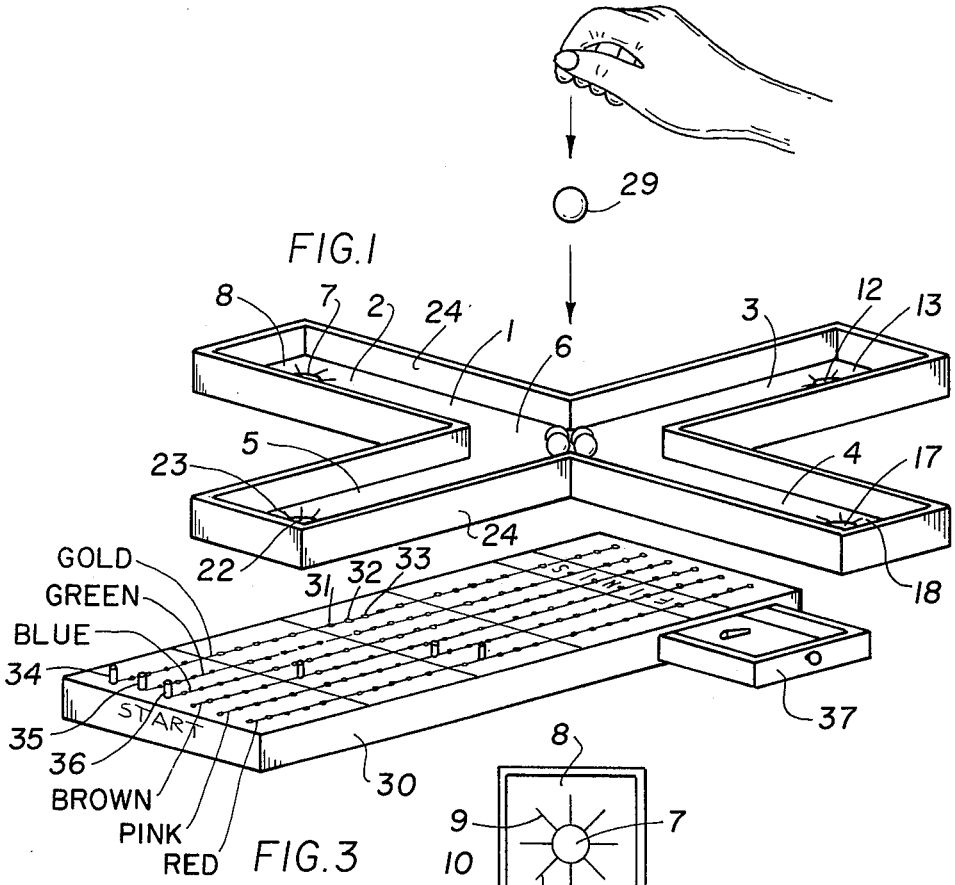
FIG.1
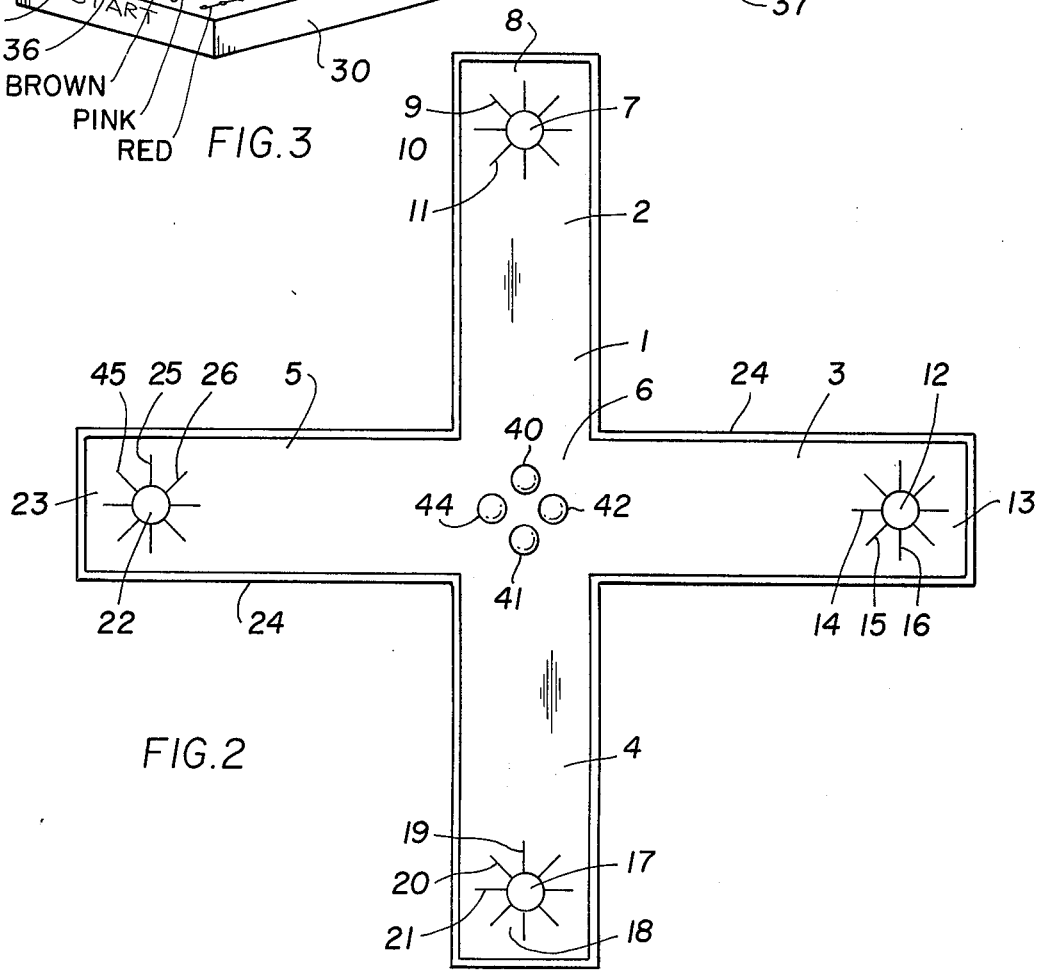
FIG.3
FIG.2

MARBLE GAME BOARD WITH SURFACE POCKETS

Description of the Invention

The present invention relates to a marble game.

Objects of the invention are to provide a marble game of simple structure, which is inexpensive in manufacture, and provides recreation, interest, pleasure, enjoyment and relaxation for the participants and onlookers.

In order that the invention may be readily carried into effect, it will now be described with reference to the accompanying drawing, wherein:

FIG. 1 is a perspective view of an embodiment of the marble game of the invention, illustrating how it is played;

FIG. 2 is a top plan, on an enlarged scale, of the embodiment of FIG. 1; and FIG. 3 is a perspective view of an embodiment of a score keeping device for the marble game of the invention.

In the FIGS., the same components are identified by the same reference numerals.

The marble game of the invention comprises a substantially cross-shaped gameboard 1 having four arms 2, 3, 4 and 5 extending radially from a central area 6 and equiangularly spaced by 90° from each other, as shown in FIGS. 1 and 2. The arms 2, 3, 4 and 5 are of equal dimensions.

A pocket is provided in each of the arms in the area of the end thereof farthest from the central area 6. Each of the pockets is adapted to accommodate a marble and has a plurality of channels formed in the arm and extending radially from the pocket.

Thus, for example, a pocket 7 is provided in the arm 2 in the area 8 of the end thereof farthest from the central area 6 and is adapted to accommodate a marble. A plurality of channels 9, 10, 11, and so on, are formed in the arm 2 and extend radially from the pocket 7. An identical pocket 12 is formed in the identical area 13 of the arm 3 and has identical channels 14, 15, 16, and so on, extending radially therefrom. An identicial pocket 17 is formed in an identical area 18 of the arm 4 and has identical channels 19, 20, 21, and so on, extending radially therefrom. An identical pocket 22 is formed in the identical area 23 of the arm 5 and has identical channels 45, 25, 26, and so on, extending radially therefrom. Each pocket 7, 12, 17 and 22 is of a specific color.

Rails 24 extend along the edges of the arms 2, 3, 4 and 5 to retain marbles on the arms.

A plurality of marbles 40, 41, 42, 44 (FIG. 2) and 29 (FIG. 1) are provided, each corresponding in color to a corresponding one of the pockets.

The marble game of the invention is called "SPLIT THE ATOM".

Five marbles are provided; 1 black, 1 blue, 1 green, 1 red, 1 white (drop marble).

Up to six people can play. The players get one turn, each round. Each player drops the white marble, from any height he chooses. He tries to make the marbles go into pockets of the same color; that is, the blue marble in the blue pocket, the red marble in the red pocket, etc. In setting the marbles in their places, the marbles are aimed at their respective colored pockets. A perfect hit in the center of the four marbles will shoot them into the right pockets.

The marbles must go into pockets of appropriate color in order to count. Thus, a blue marble in the red pocket is not counted as a point.

A score keeping device for the marble game of the invention, as shown in FIG. 3, comprises a board-like member 30 having a plurality of peg holes 31, 32, 33, and so on, formed therein in rows and columns.

A colored stripe of a color different from the others extends through each column of peg holes.

A plurality of pegs 34, 35, 36, and so on, are removably seated in the peg holes 31, 32, 33, and so on. Each peg is the color of a corresponding one of the stripes. The peg board is for keeping score. Each player selects a colored peg by which he keeps score. Suppose, for example, that a player A selects gold and a player B selects green. If the player A scores a 3, that is, he knocks three of the marbles into three pockets of the proper color, the player A pegs three holes. The game continues until one player's peg lands on or passes over the word FINIS. That ends the game. The game thus continues until a player accumulates 21 or more points of a possible maximum of 24.

An openable peg-storing drawer 37 of any suitable type is provided in the board-like member 30.

While the invention has been described by means of a specific example and in a specific embodiment, I do not wish to be limited thereto, for obvious modifications will occur to those skilled in the art without departing from the spirit and scope of the invention.

I claim:

1. A marble game, comprising a substantially cross-shaped gameboard having four substantially elongated arms extending radially from a central area and equiangularly spaced by 90°from each other, the arms being of equal dimensions;

an open pocket in each of the arms in the area of the end thereof farthest from the central area, each of the pockets being adapted to accommodate a marble;

a plurality of channels formed in each of the arms and extending radially from the pocket in each of the arms;

rails extending along the edges of the arms to retain marbles on the arms;

four marbles; said marbles being placed at said central area and being in a closely arranged substantially square pattern; a drop marble; said drop marble being dropped from a height amongst said marbles in attempting to direct them to the pockets in corresponding arms.

2. A marble game as claimed in claim 1, wherein each of the pockets is a color different from the others and selected ones of the marbles are of the same color as corresponding pockets of the arms.

* * * * *